US009418779B2

(12) United States Patent
Choi et al.

(10) Patent No.: US 9,418,779 B2
(45) Date of Patent: Aug. 16, 2016

(54) PROCESS FOR PREPARING SCALABLE QUANTITIES OF HIGH PURITY MANGANESE BISMUTH MAGNETIC MATERIALS FOR FABRICATION OF PERMANENT MAGNETS

(71) Applicants: Jung Pyung Choi, Richland, WA (US); Curt A. Lavender, Richland, WA (US); Guosheng Li, Richland, WA (US); Jun Cui, Richland, WA (US)

(72) Inventors: Jung Pyung Choi, Richland, WA (US); Curt A. Lavender, Richland, WA (US); Guosheng Li, Richland, WA (US); Jun Cui, Richland, WA (US)

(73) Assignee: BATTELLE MEMORIAL INSTITUTE, Richland, WA (US)

( * ) Notice: Subject to any disclaimer, the term of this patent is extended or adjusted under 35 U.S.C. 154(b) by 427 days.

(21) Appl. No.: 14/059,773

(22) Filed: Oct. 22, 2013

(65) Prior Publication Data

US 2015/0110664 A1 Apr. 23, 2015

(51) Int. Cl.

| | |
|---|---|
| ***B22F 1/00*** | (2006.01) |
| ***C22C 1/02*** | (2006.01) |
| ***C22C 1/04*** | (2006.01) |
| ***H01F 1/047*** | (2006.01) |
| ***H01F 1/08*** | (2006.01) |

(52) U.S. Cl.

CPC *H01F 1/047* (2013.01); *C22C 1/02* (2013.01); *C22C 1/04* (2013.01); *H01F 1/08* (2013.01); *B22F 2998/10* (2013.01); *B22F 2999/00* (2013.01); *C22C 2202/02* (2013.01)

(58) Field of Classification Search

CPC ..... B22F 1/0085; B22F 2998/10; B22F 2999/00; B22F 2201/20; C22C 1/02; C22C 1/04; C22F 2202/02; H01F 1/047; H01F 1/08

USPC ..... 419/33; 75/345, 348; 148/101, 103; 252/62.55

See application file for complete search history.

(56) References Cited

U.S. PATENT DOCUMENTS

| | | | | |
|---|---|---|---|---|
| 4,778,542 | A | 10/1988 | Clemens | |
| 4,784,703 | A * | 11/1988 | Pirich | C30B 21/02 148/101 |
| 5,648,160 | A * | 7/1997 | Kishimoto | H01F 1/047 148/105 |
| 6,143,096 | A * | 11/2000 | Kitahata | H01F 1/0027 252/62.55 |
| 2015/0125341 | A1 * | 5/2015 | Hong | H01F 1/047 420/434 |

OTHER PUBLICATIONS

Yang, Y. B., et al., Temperature dependences of structure and coercivity for melt-spun MnBi compound, Journal of Magnetism and Magnetic Materials, 330, 2013, 106-110.

Yang, J. B., et al, Crystal structure, magnetic properties and electronic structure of the MnBi intermetallic compound, J Phys Condens Matter, 14, 6509-6519, Jun. 2002.

Yang, J. B., et al., Anisotropic nanocrystalline MnBi with high coercivity at high temperatures, Applied Physics Letters, 99, 082505, Aug. 2011.

Yang, J. B., et al, Magnetic properties of the MnBi intermetallic compound, Applied Physics Letters, 79, 12, 1846-1849, Sep. 2001.

Guo, X., et al., Magnetic properties of MnBi prepared by rapid solidification, Physical Review B, 46, 22, 14578-145826, Dec. 1992.

Yang, Y. B., et al., Preparation and magnetic properties of MnBi, Journal of Applied Physics, 111, Feb. 2012.

(Continued)

*Primary Examiner* — Helene Klemanski

(74) *Attorney, Agent, or Firm* — James D. Matheson

(57) ABSTRACT

A scalable process is detailed for forming bulk quantities of high-purity α-MnBi phase materials suitable for fabrication of MnBi based permanent magnets.

20 Claims, 3 Drawing Sheets

(56) References Cited

OTHER PUBLICATIONS

Okamoto, H.,Bi—Mn phase diagram, ASM Handbook, ASM International, vol. 3, 1992.
Yoshida, H., et al., Preparation of Highly Pure MnBi Intermetallic Compounds by Arc-Melting, Materials Transactions, JIM, 40, 5, 455-458, Apr. 1999.
Guo, X, et al, The formation of single-phase equiatomic MnBi by rapid solidification, J Mater Res, 5, 11, 2646-2651, Aug. 1990.
Roberts, B. W., Neutron Diffraction Study of the Structures and Magnetic Properties of Manganese Bismuthide, Physical Review, 104, 607-616, Nov. 1956.
Guo, X., et al., Formation of MnBi ferromagnetic phases through crystallization of the amorphous phase, J Appl Phys, 69, 8, 6067-6069, Apr. 1991.
Rao, N. V. R., et al., Anisotropic fully dense MnBi permanent magnet with high energy product and high coercivity at elevated temperatures, J Phys D Appl Phys, 46, 1-4, Jan. 2013.
Rodewald, W., et al., Top Nd—Fe—B Magnets with Greater than 56 MGOe Energy Density and 9.8 kOe Coercivity, IEEE Transactions on Magnetics, 38, 5, 2955-2957, Sep. 2002.
Oikawa, K., et al., Thermodynamic Assessment of the Bi—Mn System, Material Transactions, 52, 11, 2032-2039. Oct. 2011.

* cited by examiner

PROCESS FOR PREPARING SCALABLE QUANTITIES OF HIGH PURITY MANGANESE BISMUTH MAGNETIC MATERIALS FOR FABRICATION OF PERMANENT MAGNETS

STATEMENT REGARDING RIGHTS TO INVENTION MADE UNDER FEDERALLY-SPONSORED RESEARCH AND DEVELOPMENT

This invention was made with Government support under Contract DE-AC05-76RLO-1830 awarded by the U.S. Department of Energy. The Government has certain rights in the invention.

FIELD OF THE INVENTION

The present invention relates generally to processes for making permanent magnets. More particularly, the present invention relates to processes for production of bulk quantities of high-purity manganese bismuth powders suitable for production of permanent magnets for energy production applications.

BACKGROUND OF THE INVENTION

Manganese Bismuth (MnBi) is an attractive alternative to permanent magnets containing rare earth elements such as NdFeB—Dy and SmCo used in medium-temperature (423 K to 473 K) applications. MnBi has unique temperature properties. For example, MnBi has a coercivity ($H_c$) value that increases with increasing temperature, reaching a maximum of 2.6 T at 523 K (250° C.). This large coercivity is attributed to MnBi's large magnetocrystalline anisotropy ($1.6\times10^6$ J/m$^3$). MnBi has a relatively low magnetization value. At room temperature, its saturation magnetization is about 75 emu/g or 8.4 kG in a 5 T field. The corresponding maximum theoretical energy product $(BH)_{max}$ is about 17.6 MGOe. The roadmap for developing a MnBi-based magnet starts with preparing a high purity MnBi compound in a large quantity. However, synthesizing MnBi is a challenge. Melting temperatures of Mn and Bi are 1519 K (1246° C.) and 544 K (271° C.), respectively. The Mn—Bi phase diagram (ASM Alloy Phase Diagram Database, ASM International, Materials Park, Ohio, USA) shows that undesired peritectic reactions occur over a wide range of temperatures and compositions. Processes are further complicated by a eutectic reaction that occurs between liquid bismuth (Bi) metal and solid MnBi at a temperature of 535 K (262° C.), which limits the maximum temperature to which composite materials can be exposed. While this eutectic temperature is about 112 K higher than the desired operating temperature of 423 K (150° C.), it is low for fabrication methods that include sintering and hot pressing for typical bulk magnets.

Several parameters are used to characterize a magnetic material: remnant magnetization ($B_r$), coercivity force ($H_c$), and maximum energy product ($(BH)_{max}$). The ($B_r$) value is a measure of magnet strength in the absence of an external magnetic field. The coercivity force or value ($H_c$) is a measure of a magnetic material's ability to remain magnetized in an external field. $(BH)_{max}$ represents the maximum product between an induced magnetization value and a corresponding applied field. However, a high ($B_r$) value or a high ($H_c$) value does not mean a high $(BH)_{max}$ value, as many magnetic materials retain either a high ($B_r$) value or a high ($H_c$) value, but not both. TABLE 1 lists properties of several important magnetic materials, including MnBi.

TABLE 1 lists magnetic properties of common magnetic materials.

| | Magnetization ($B_r$) kG | Coercivity ($H_c$) kOe | Energy Product $(BH)_{max}$ MGOe |
|---|---|---|---|
| $Fe_{14}Nd_2B$ | 12 | 12 | 40 |
| AlNiCo-9 | 10.5 | 1.6 | 8.5 |
| MnBi | 4.8 | 15 | 7.7 |
| Fe | 21.5 | 0.001 | 0.02 |
| FeCo | 24.5 | 0.002 | 0.05 |

"Hard" magnetic materials do not magnetize or de-magnetize easily. "Soft" magnetic materials magnetize and de-magnetize easily. A magnetic material is considered "hard" if its coercivity ($H_c$) is greater than 1000 Oe, and "soft" if the ($H_c$) value is less than 100 Oe. Generally, "hard" permanent magnets have a coercivity value greater than 3000 Oe, and, in some case, a coercivity value over 10,000 Oe. "Soft" magnetic materials typically exhibit a coercivity ($H_c$) less than 10 Oe, and, in some cases, a coercivity ($H_c$) of 0.1 Oe.

Several conventional approaches are used to prepare single-phase MnBi materials, including arc-melting, sintering, and melt-spin/rapid solidification. Of these approaches, only melt-spin/rapid solidification has been able to consistently produce low-temperature phase (LTP) MnBi, also referred herein as α-MnBi, at a purity over 90%. In this approach, rapid cooling freezes MnBi in an amorphous phase. Subsequent heat treatment allows the amorphous phase to crystallize yielding fine grains of MnBi at a 1:1 stoichiometric ratio. The advantage of the melt-spin/rapid solidification approach is the high purity and high quality of the obtained material. However, the approach has a significant disadvantage in that productivity (i.e., productive yields) is low and the cost is high. For example, the melt-spin process involves injecting molten metal onto a rapidly rotating wheel, which throws solidified metal into a chamber. The injection and the throwing actions provide a continuous ribbon of the high-purity material. However, due to the necessity of maintaining high temperatures and the formation of the thin ribbon product obtained, the productivity of the approach is limited.

In another powder metallurgy approach, powders of Mn and Bi are mixed and then sintered to produce LTP phase MnBi. However, this approach provides a yield of α-MnBi that is less than 50%. And, the α-MnBi phase material is not easily separated from unreacted manganese (Mn) and bismuth (Bi) metal phases in the composite material.

In yet another approach, LTP phase MnBi is produced via conventional casting followed by heat treatment. In this approach, after arc melting, the obtained ingot is annealed at 300° C. for 24 hours. The powder obtained exhibits a saturation magnetization of 60 emu/g in an applied field of 30 kOe at room temperature, which is equivalent to a purity of MnBi of 74%, assuming the magnetization of 100% pure LTP MnBi is 81 emu/g in an applied field of 30 KOe. Results show that simple annealing cannot produce LTP phase MnBi at a purity greater than 90%.

Accordingly, new processes are needed that produce mass (kg) quantities of high-purity (>90%) MnBi magnetic materials with suitable properties for energy production applications. The present invention addresses these needs.

SUMMARY OF THE INVENTION

A process is disclosed for fabrication of mass or bulk quantities of high-purity (>90%) α-MnBi alloys suitable for scalable production of MnBi permanent magnets. The process may include: combining selected atomic ratios of manganese (Mn) metal and bismuth (Bi) metal together. The quantity of (Mn) metal in the mixture may be greater than that for the (Bi) metal (i.e., greater than 50:50). The Mn-rich mixture may be melted in a selected melter to form a solid composite alloy. In various embodiments, the melter may be an arc-melter or an induction melter. The composite alloy may be in the form of an ingot or pellet. The solid ingot or pellet may include a fraction of α-MnBi phase material between about 40 wt % and about 50 wt %.

The solid ingot or pellet may be heat treated in two temperature regimes for selected times at selected conditions. A first temperature regime may include a temperature less than or equal to about 266° C. Heating may be performed in an oxygen-free or reducing gas environment for a time sufficient to increase the fraction or purity of α-MnBi phase material. In some embodiments, time in the first temperature regime is 8 hours or longer. In various embodiments, the fraction or purity of α-MnBi phase material obtained in the first temperature regime increases to between about 50 wt % and 60 wt % on average. A second temperature regime may include a temperature between about 266° C. and about 358° C. Heating may again be performed in an oxygen-free or reducing gas environment for a time sufficient to increase the quantity or fraction of α-MnBi phase material that is formed. In some embodiments, time in the second temperature regime is 5 hours or longer. In various embodiments, the fraction or purity of α-MnBi phase material obtained in the second temperature regime increases to between about 60 wt % and about 70 wt %. The remaining 30% to 40% of the composite material may be in the form of unreacted (free) manganese Mn metal and unreacted (free) Bi metal in an approximate 1:1 atomic ratio.

The heat treated ingot or pellet may be cooled after heating at a rate between about 1° C. per minute about 10° C. per minute to decompose any β-MnBi phase material formed in the composite alloy. Decomposition of β-MnBi phase material increases the quantity of α-MnBi phase material in the composite alloy.

The heat-treated ingot or pellet may be milled with selected milling devices to fracture the "hard" α-MnBi phase material in the ingot or pellet into a powder. Milling devices include, but are not limited to, e.g., hand mills, power mills, roll mills, and attrition mills. Milling agglomerates quantities of remaining unreacted (free) Bi metal and unreacted (free) Mn metal together that were originally present in the ingot or pellet. Milling may include sieving the fractured α-MnBi phase material to separate the α-MnBi phase material as a powder with particles of a selected particle size from agglomerates containing quantities of unreacted (free) Bi metal and unreacted (free) Mn metals. In some embodiments, particle size of the α-MnBi phase material may be less than about 44 μm on average. However, particle sizes are not limited. The milled and sieved powder may include a fraction or purity of α-MnBi phase material between about 70 wt % and about 80 wt % on average.

The fractured α-MnBi phase powder may be vacuum heat treated in a vacuum at a vacuum pressure between about $1\times10^{-2}$ Torr and about $2\times10^{-5}$ Torr and a temperature selected between about 250° C. and about 300° C. to vaporize releasable quantities of unassociated Bi metal from the powder. The vacuum heat treatment also promotes reaction between residual unreacted Mn metal and unreacted Bi metal in the powder that increases the fraction of α-MnBi phase material in the composite. Vacuum heat treated powder may achieve a purity of α-MnBi phase material above about 90 wt %. The vacuum and heat treated powder may be cooled in vacuum to permit further milling, grinding, and sieving of the powder that again agglomerates quantities of unreacted Mn metal and Bi metal together that remain in the powder and further separates portions of fractured α-MnBi phase powder for collection. The milling and purifying steps may be performed iteratively to increase the purity of the α-MnBi phase material in the end product. In some embodiments, the α-MnBi phase material product includes a purity greater than about 90 wt %. In some embodiments, the α-MnBi phase material product includes a purity greater than about 95 wt %. In some embodiments, the α-MnBi phase material product has a purity between about 90 wt % and about 99 wt %. In some embodiments, the high-purity α-MnBi product may be a single-phase material.

In some embodiments, the process of the present invention produces high-purity α-MnBi phase magnetic material at quantities greater than or equal to about 100 grams in a single process batch. In various embodiments, the process of the present invention produces high-purity α-MnBi phase magnetic material at scalable and industrial quantities greater than about 1 kilogram (>1000 g) in a single process batch.

The process may include magnetizing the high-purity α-MnBi alloy product in a selected magnetic field.

High-purity α-MnBi phase material of the present invention contains no rare earth elements which are presently scarce in the United States. The high-purity α-MnBi alloy product may be included as a component of a permanent magnet. For example, MnBi is the only known ferromagnetic material with a coercivity value that increases significantly with increasing temperature. This property makes the high-purity α-MnBi alloy product of the present invention an ideal candidate for use as the "hard" phase in exchange-coupled composite magnets used, e.g., in electric devices including electric vehicles, as well as other applications at elevated temperatures (e.g., above 200° C.). Thus, the high-purity α-MnBi alloy product may be incorporated as a component of a permanent magnet containing device. The present invention provides α-MnBi phase magnetic materials with reproducible magnetic properties.

The purpose of the foregoing abstract is to enable the United States Patent and Trademark Office and the public generally, especially scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

A process is disclosed for fabricating bulk quantities of high-purity low-temperature phase (LTP) MnBi powders suitable for production of high-performance permanent magnets. The following description includes a best mode of the present invention. While the invention is susceptible of various modifications and alternative constructions, there is no intention to limit the invention to the specific forms disclosed. The invention is intended to cover all modifications, alternative constructions, and equivalents falling within the spirit and scope of the invention as defined in the claims. Therefore the present description should be seen as illustrative and not limiting.

Figure 1:
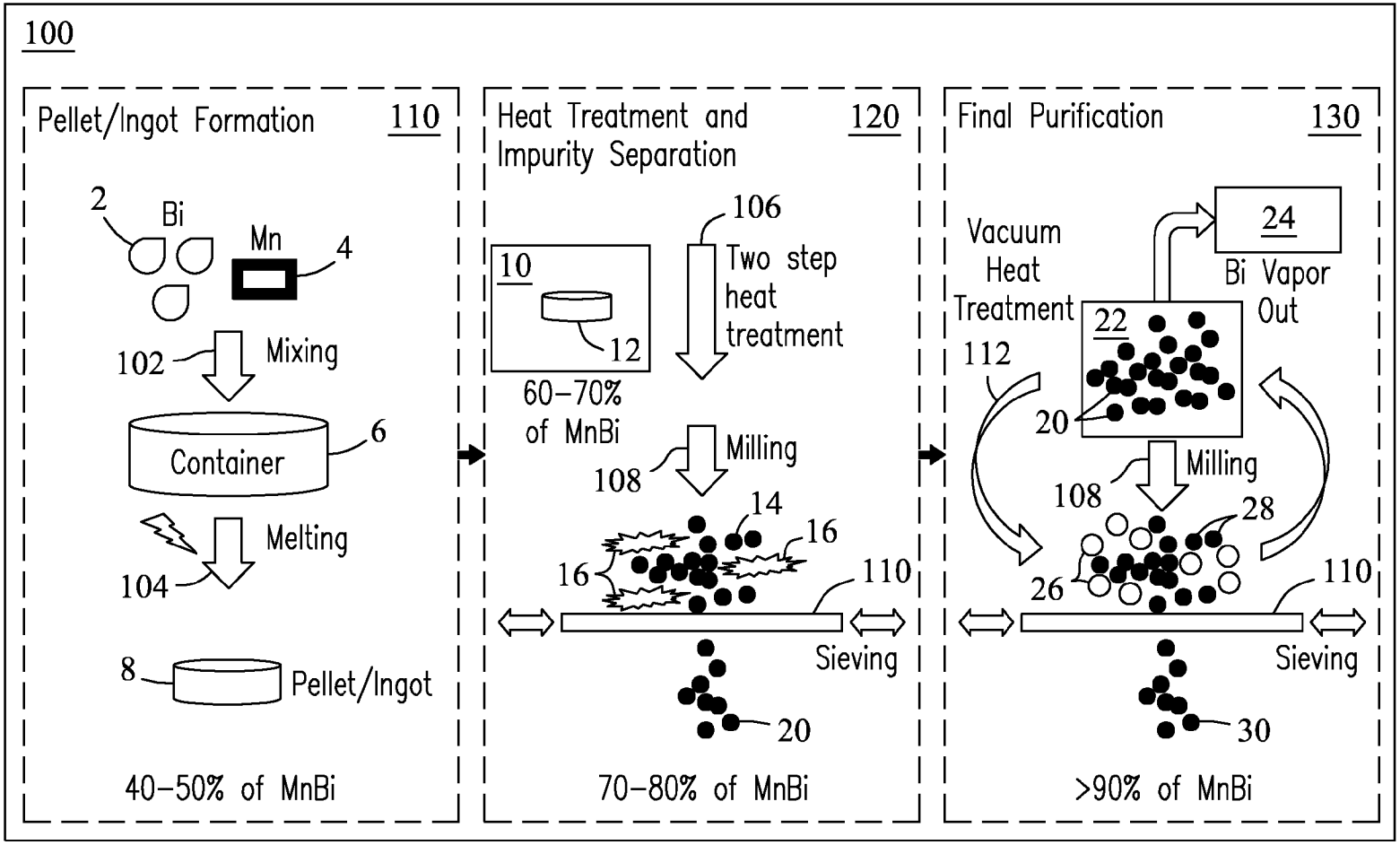
FIG. 1 shows an exemplary process of the present invention for fabrication of bulk quantities of high-purity MnBi magnetic material.

FIG. 1 illustrates exemplary steps of a process 100 for fabrication of bulk quantities of high-purity (>90%) α-MnBi phase material suitable for production of MnBi permanent magnets. The term "bulk quantity" as used herein means a quantity greater than or equal to 100 grams and scalable production quantities of kilograms or more. However, quantities are not intended to be limited.

[Pellet/Ingot formation 110]. Process 100 may include combining (e.g., by mixing) 102 selected quantities of bismuth (Bi) metal 2 and manganese (Mn) metal 4 together, e.g., in a container 6 to form mixtures with selected metal ratios. Forms of the metals may include, but are not limited to, e.g., particles, pellets, powders, chunks, rods, wedges, wires, filaments, shavings, filings, slivers, including combinations of these various forms. The quantity of manganese (Mn) metal 4 in the mixture may be greater than that for bismuth (Bi) metal 2 (i.e., greater than 50:50). Mixtures may be melted 104 in selected melters (not shown) to form a solid pellet or ingot 8. In various embodiments, the melter may be an arc-melter or an induction melter or other suitable melting devices. No limitations are intended. After melting, ingot 8 typically includes a purity or fraction of α-MnBi phase material between about 40 wt % and about 50 wt % on average.

[Heat treatment and Impurity Separation 120]. The ingot may be heat treated 106 in two temperature regimes for selected times at selected conditions, e.g., in a furnace 10 to increase the fraction of α-MnBi phase material in the ingot. Each temperature regime may include selected temperatures and process times. For example, the ingot may be heated 106 in a first temperature regime at a first temperature less than or equal to about 266° C. in an oxygen-free atmosphere or reducing atmosphere (e.g., in hydrogen gas to minimize oxidation) for a time sufficient to increase the fraction of α-MnBi phase magnetic material. In some embodiments, heating 106 in the first temperature regime may include a time of up to 8 hours or longer. In various embodiments, yield of α-MnBi phase magnetic material in the first temperature regime may be between about 50 wt % and 60 wt % on average. The ingot may then be heated 106 in a second temperature regime at a temperature between about 266° C. and about 358° C. in a reducing environment for a time sufficient to yield a heat-treated ingot 12 that includes a fraction or purity of α-MnBi phase material typically between about 60 wt % and about 70 wt %. Residual fractions of unreacted Mn metal (not shown) and unreacted Bi metal (not shown) may remain in heat-treated ingot 12. In some embodiments, heat treatment 106 in the second temperature regime may include a time of up to 5 hours or longer. Heat-treated ingot 12 may then be cooled at a low cooling rate between about 1° C. per minute and about 10° C. per minute to remove any high-temperature MnBi phase material (also known as β-MnBi phase material) present in ingot 12. When cooled at this rate, any β-MnBi phase material decomposes to produce additional α-MnBi phase material and additional Mn metal. Heat-treated ingot 12 may be milled 108 with selected milling devices (not shown) to fracture the "hard" α-MnBi phase magnetic material present in ingot 12 into a powder 14 containing between about 60 wt % and about 70 wt % α-MnBi phase material. Milling 108 also agglomerates or combines unreacted (free) Bi metal and unreacted (free) Mn metal remaining in the heat-treated ingot 12 together into agglomerated masses (agglomerates) 16. Milling 108 may include sieving 110 milled powder 14 to provide particles of the fractured α-MnBi phase material with a selected particle size. In some embodiments, milling 108 may provide particles of α-MnBi material with an average size below about 45 microns (45 μm). However, particle sizes are not intended to be limited.

The milled and fractured powder 14 containing α-MnBi phase material when separated from agglomerates 16 containing unreacted Bi and Mn metals yields a α-MnBi phase powder 20 with a purity between about 70 wt % and about 80 wt %.

[Final purification 130]. Fractured powder 20 containing between about 70 wt % and about 80 wt % α-MnBi phase material may be further purified by subsequent vacuum heat treatment 112, e.g., in a vacuum furnace 22 at a temperature between about 250° C. and about 300° C. Vacuum pressure may be between about $1\times10^{-2}$ Torr and about $2\times10^{-5}$ Torr. Vacuum heat treatment 112 vaporizes a releasable quantity of residual Bi metal from as a Bi metal vapor 24 from powder 20. Vacuum heat treatment 112 also promotes further reaction between residual Bi metal (not shown) and residual Mn metal (not shown) in powder 20, which increases the fraction and purity of α-MnBi magnetic material in powder 20. The vacuum and heat treated powder may be cooled under vacuum e.g., to room temperature to permit additional milling 108 (e.g., grinding). Milling 108 serves to fracture any newly obtained α-MnBi phase magnetic material into a powder 28 and to agglomerate remaining fractions of unassociated Mn metal and Bi metal together as newly agglomerated masses (agglomerates) 26. New agglomerates 26 can be separated from newly fractured powder 28, e.g., by sieving 110 fractured powder 28. Sieving 110 yields a high-purity α-MnBi phase material powder 30 with a purity or fraction of α-MnBi phase material greater than about 90 wt %.

Vacuum heat treatment 112 and milling 108 may be performed iteratively to progressively increase the purity of the α-MnBi phase magnetic material in the collected product. Agglomerates containing unreacted Bi and Mn metals may be collected and recycled, e.g., by melting the agglomerates collected at each step of the process. In some embodiments, iterative vacuum heat treatments 112 with subsequent milling 108 and sieving 110 achieves a purity of the α-MnBi phase magnetic material in the alloy product 30 of greater than about 95 wt %. In some embodiments, purity of the α-MnBi phase magnetic material in the alloy product 30 is between about 90 wt % and about 99 wt %. The process of the present invention produces high-purity (>90 wt %) α-MnBi phase magnetic material at bulk quantities greater than 100 grams. The process is also scalable, permitting fabrication of greater than kilogram quantities of α-MnBi phase magnetic material for industrial applications.

Figure 2:
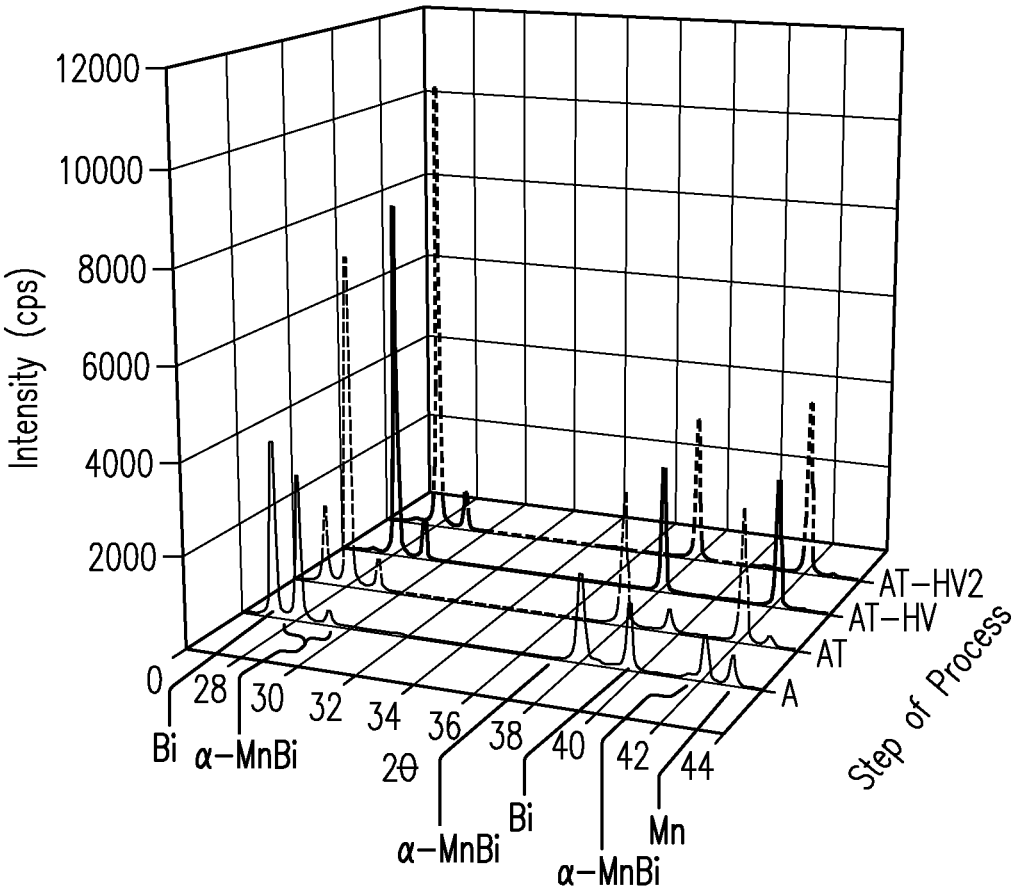
FIG. 2 is an XRD plot showing diffraction patterns for materials present in mixtures at each step of the fabrication process.

FIG. 2 plots X-ray Diffraction (XRD) results showing compositions in samples at each step of the fabrication process. In the figure, peak intensities for components including Mn metal, Bi metal, and α-MnBi phase material are shown plotted against a Bragg diffraction angle (2θ). Peaks in the figure indicate relative quantities of selected phases in samples undergoing XRD analysis. Peaks corresponding to unassociated (free) (Bi) metal appear in the figure at a 2θ value of about 27 degrees and about 38 degrees, respectively. An XRD peak for unassociated (free) Mn metal appears in the figure at a 2θ value of about 43 degrees. XRD peaks for α-MnBi phase magnetic material appear in the figure at a 2θ value of about 29 degrees, about 38 degrees, and about 42 degrees, respectively.

Melting [A]. After melting Bi metal and Mn metal together, XRD results show the presence of an unassociated (free) Bi metal phase, as evidenced by peaks positioned at 2θ values of 27 degrees and 38 degrees, respectively. An unassociated (free) Mn metal phase is shown by presence of an XRD peak positioned at a 2θ value of 43 degrees. Finally, an α-MnBi material phase is shown by presence of XRD peaks positioned at 2θ values of about 29 degrees, 38 degrees, and 42 degrees, respectively.

Milling [AT]. After milling and the heat treatment at two selected temperature regimes, results show the intensity of the Bi metal peak positioned at a 2θ value of 27 degrees decreases from about 3800 cps to about 1300 cps. Intensity of the peak corresponding to the α-MnBi phase magnetic material positioned at a 2θ value of 29 degrees increases from about 2200 cps to about 6800 cps showing the quantity of the α-MnBi phase magnetic material increases dramatically.

First Vacuum Heat Treatment [AT-HV]. Following a $1^{st}$ vacuum heat treatment at, e.g., 290° C. and a pressure of about $10^{-2}$ Torr, results show the intensity of the peak positioned at a 2θ value of 27 degrees corresponding to unreacted Bi metal decreases to nearly zero. Free Bi metal is released, e.g., as a vapor from the solid powder during the vacuum heat treatment process. A corresponding increase in the intensity of the peak corresponding to the α-MnBi phase material positioned at a 2θ value of about 28 degrees is observed. Intensity increases from about 6800 cps (i.e., measured after a first milling) to about 7800 cps, showing the increase in the quantity of the α-MnBi phase magnetic material.

Second Vacuum Heat Treatment [AT-HV2]. Following a $2^{nd}$ vacuum heat treatment at, e.g., 290° C. and a pressure of about $10^{-2}$ Torr (and following additional milling and sieving), results show an additional decrease in the intensity of the peak positioned at a 2θ value of 27 degrees corresponding to residual Bi metal. An additional increase is observed in the intensity of the first peak (at a 2θ value of about 28 degrees) of the α-MnBi phase material from about 7800 cps (e.g., measured previously after a first vacuum heat treatment) to over 10,000 cps. Progressive increases in the fraction of the α-MnBi phase magnetic material are achieved by vaporizing additional fractions of Bi metal from the composite alloy during vacuum heat treatment. Results further show a decrease in the intensity of the peak corresponding to free Mn metal phase (positioned at a 2θ value of about 43 degrees) as the process proceeds through the $2^{nd}$ vacuum distillation treatment. Concentration of the α-MnBi phase magnetic material increases.

Figure 3A:
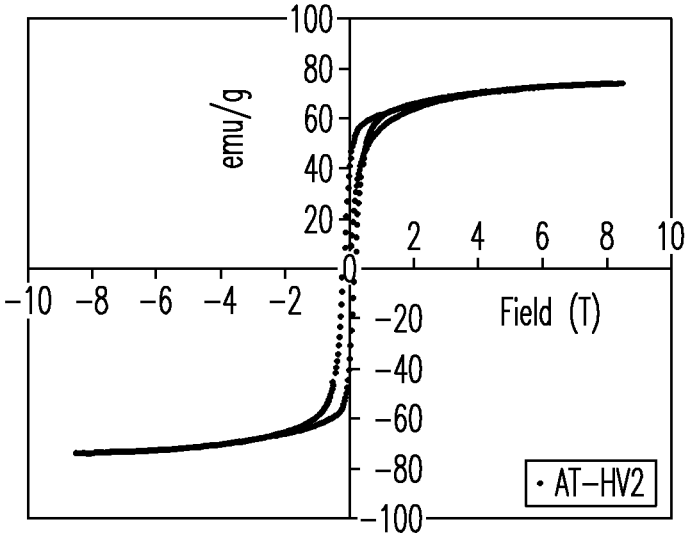
FIGS. 3*a*-3*b* show Vibrating Sample Magnetometer (VSM) test results for MnBi magnetic materials fabricated by the present invention.

FIG. 3*a* plots results from Vibrating Sample Magnetometer (VSM) tests performed at an independent testing laboratory (Ames Laboratory, Ames, Iowa, USA) for a representative high-purity α-MnBi phase magnetic material of the present invention. In the figure, Magnetization (M) is plotted against the applied magnetic field (H) at room temperature. The saturation magnetization is about 74 emu/g, which equates with a purity for the α-MnBi phase magnetic material of 91.4%. Results assume any impure phases are non-magnetic. Saturation magnetization of a 100% pure α-MnBi phase magnetic material is 81 emu/g.

Figure 3B:
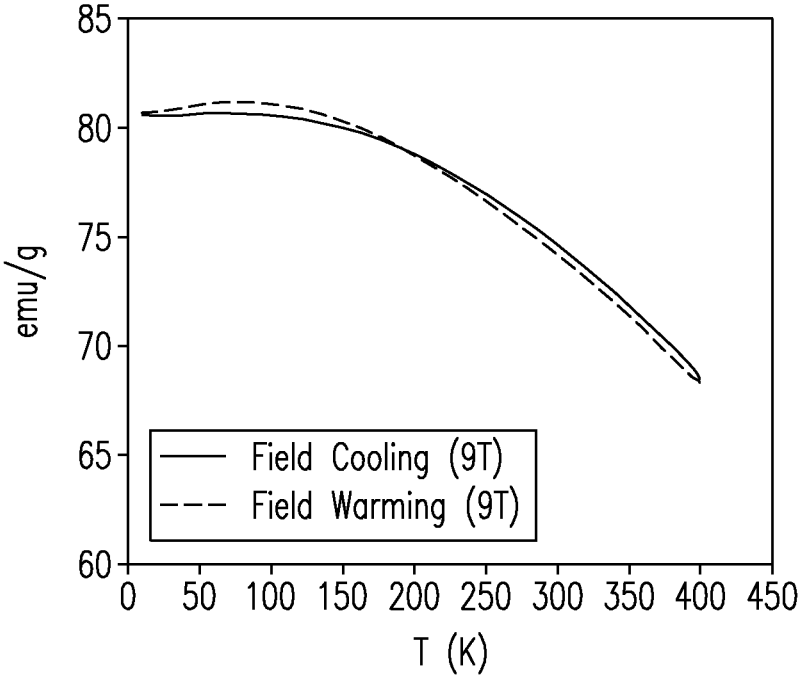

FIG. 3*b* plots results obtained from Vibrating Sample Magnetometer (VSM) tests for a representative bulk quantity of high-purity α-MnBi phase magnetic material obtained in concert of the present invention performed at an independent testing laboratory (Ames Laboratory, Ames, Iowa, USA) conducted at 9 T. In the figure, magnetization (M) is plotted as a function of temperature (K). VSM test data show a greater than 91% purity for the α-MnBi phase magnetic material at 9 T.

Applications

The present invention produces bulk quantities of high-purity α-MnBi phase magnetic material alloys that find application in production of permanent magnets suitable for use in energy devices including, but not limited to, e.g., electric generators, electric motors including those used in vehicles and other devices, as well as high-temperature (>150° C.) applications. The present invention produces high-purity α-MnBi phase magnetic materials at quantities greater than hundred grams in a single run. The process is also scalable for industrial scale fabrication at kilogram (kg) quantities of high-purity α-MnBi phase magnetic materials. Magnetization properties of the material are reproducible. And, random sample analyses show consistent quality.

The following example provides a further understanding of various aspects of the present invention in its larger aspects.

Example

Synthesis of α-MnBi

~20 grams of a 50:50 atom percent ratio mixture was prepared with pieces of manganese (Mn) metal (e.g., 99.99% Mn, Aldrich, USA) and bismuth (Bi) metal (e.g., 99.99% Bi, Aldrich, location, USA). An additional 0.8 grams of manganese (Mn) metal was added to the sample mixture for a total weight of 20.8 grams. The 20.8 gram mixture was cold pressed together to form a pellet. Eight pellets were used for each casting run. Pellets were melted together in an arc-melter to form an ingot. The ingot was arc-melted three (3) times to ensure homogeneity. The resulting ingot had a bar shape and had a shiny metallic color. The ingot was heat treated in a pure hydrogen gas atmosphere to prevent oxidation. The ingot was heated in a first temperature regime to a temperature of 250° C. at a ramp rate of 2° C./min and heated at temperature for a time of 8 hours. The heat-treated ingot was then heated in a $2^{nd}$ temperature regime to a temperature of 325° C. at a ramp rate of 2° C./min and heated for 5 hours at temperature. Magnetization of the heat treated ingot was 50 emu/g, indicating a purity of 62%. The resulting MnBi-containing ingot was then crushed, ground, and sieved. The grinding fractures the "hard" α-MnBi phase from the MnBi-containing ingot that was collected while sieving. In exemplary tests, a 400 mesh made of stainless steel was used. About 60% (100 g) of the sieved powder was obtained from the original 166 gram ingot. The collected "hard" α-MnBi phase material was then heat treated at 290° C. under a vacuum pressure of about $10^{-2}$ Torr for 24 hours. During this period, vaporization of Bi metal from the powder decreased the weight of the powdered sample by a factor of about 1 wt %. Resulting vacuum-heat-treated powder was again ground and heat treated at 290° C. under a vacuum pressure of about $10^{-2}$ Torr for 24 hours. The $2^{nd}$ round of heat treatment in vacuum resulted in additional vaporization of Bi metal that decreased weight of the powder by about 0.4%. Ground powder may be iteratively heat treated in vacuum to vaporize additional quantities of Bi metal to increase the purity of the α-MnBi phase magnetic material in the powder. However, after two iterations, the increase in purity with each successive iteration decreases to less than about 0.2% on average. Magnetization of the resulting powder after 2 vacuum heat treatments is about 74 emu/g, indicating purity of the resulting material is about 91.3%. Neutron diffraction analysis of the powder validates the purity of the powder is about 91%. These high purity powders may be used as starting materials for fabrication of permanent magnets.

While preferred embodiments of the present invention have been shown and described, it will be apparent to those of ordinary skill in the art that many changes and modifications may be made without departing from the invention in its true scope and broader aspects. The appended claims are therefore intended to cover all such changes and modifications as fall within the spirit and scope of the invention.

What is claimed is:

1. A process for preparing a high-purity α-MnBi magnetic alloy, comprising:

melting manganese (Mn) metal and bismuth (Bi) metal together in a ratio that is greater in manganese (Mn) metal than in bismuth (Bi) metal to form an alloy comprising between about 40 wt % and about 50 wt % α-MnBi material and residual fractions of unreacted manganese (Mn) metal and unreacted bismuth (Bi) metal therein;

heat treating the alloy in an oxygen-free gas atmosphere at a first temperature less than or equal to about 266° C. for a time up to about 8 hours sufficient to form at least about 60 wt % α-MnBi material therein and a second temperature between about 266° C. and about 358° C. for a time up to about 5 hours sufficient to form a quantity of β-MnBi material therein;

cooling the alloy after heating at a rate between about 1° C. per minute to about 10° C. per minute to decompose the quantity of β-MnBi material therein to increase the quantity of α-MnBi material therein;

milling the alloy to agglomerate unreacted manganese (Mn) metal and unreacted bismuth (Bi) metal together therein and to fracture the α-MnBi material therefrom;

sieving the milled alloy to collect the fractured α-MnBi material as a powder comprised of particles thereof in a fraction separate from the agglomerated manganese (Mn) and bismuth (Bi) metals fraction; and heat treating the fractured α-MnBi material fraction in a vacuum at a temperature selected between about 250° C. and about 300° C. for a time sufficient to form the high-purity α-MnBi magnetic alloy comprising at least about 90 wt % α-MnBi material therein.

2. The process of claim 1, wherein the melting is performed in an arc melter or an induction melter.

3. The process of claim 1, wherein the melting yields the alloy in the form of a solid pellet or solid ingot.

4. The process of claim 1, wherein the milling is performed in a hand mill, a power mill, a roll mill, or an attrition mill.

5. The process of claim 1, wherein the milling includes forming particles of α-MnBi material with an average size below about 45 microns (45 μm).

6. The process of claim 1, wherein heat treating the fractured α-MnBi material fraction in vacuum includes removing residual (Bi) metal as a vapor from the fractured fraction at a vacuum pressure selected between about $1\times10^{-2}$ Torr and about $2\times10^{-5}$ Torr.

7. The process of claim 1, wherein heat treating the fractured α-MnBi material fraction in vacuum includes reacting unreacted (Bi) metal and unreacted (Mn) metal therein to increase the quantity of α-MnBi material therein.

8. The process of claim 1, wherein the steps of milling the alloy and heat treating the fractured α-MnBi material fraction in vacuum are performed iteratively to increase the quantity of α-MnBi material in the high-purity α-MnBi magnetic alloy to greater than about 95 wt %.

9. The process of claim 1, wherein the steps of milling the alloy and heat treating the fractured α-MnBi material fraction in vacuum are performed iteratively to increase the quantity of α-MnBi material in the high-purity α-MnBi magnetic alloy to greater than about 90 wt % to about 99 wt %.

10. The process of claim 1, wherein the high-purity α-MnBi magnetic alloy includes a mass greater than or equal to about 100 grams in a single process batch.

11. The process of claim 1, wherein the high-purity α-MnBi magnetic alloy includes a mass greater than or equal to about 1 kilogram in a single process batch.

12. The process of claim 1, further including magnetizing the high-purity α-MnBi magnetic alloy.

13. The process of claim 1, wherein the high-purity α-MnBi magnetic alloy is incorporated as a component of a permanent magnet.

14. The process of claim 1, wherein the high-purity α-MnBi alloy magnetic is incorporated as a component of a permanent magnet-containing device.

15. A process for preparing a high-purity α-MnBi magnetic alloy, comprising:

melting manganese (Mn) metal and bismuth (Bi) metal together in a selected ratio that is greater in manganese (Mn) metal than in bismuth (Bi) metal to form an alloy comprising between about 40 wt % and about 50 wt % α-MnBi material and residual fractions of unreacted manganese (Mn) metal and unreacted bismuth (Bi) metal therein;

heat treating the alloy in an oxygen-free atmosphere at a first temperature less than or equal to about 266° C. for a time sufficient to form at least about 60 wt % α-MnBi material therein and a second temperature between about 266° C. and about 358° C. for a time sufficient to form a quantity of β-MnBi material therein;

milling the alloy to agglomerate unreacted manganese (Mn) metal and unreacted bismuth (Bi) metal together therein and to fracture the at least about 60 wt % α-MnBi material therefrom into separate fractions; and heat treating the fractured α-MnBi material fraction in a vacuum at a temperature selected between about 250° C. and about 300° C. for a time sufficient to form the high-purity α-MnBi magnetic alloy comprising at least about 90 wt % α-MnBi material therein.

16. The process of claim 15, wherein the oxygen-free atmosphere includes a reducing gas.

17. The process of claim 15, wherein heat treating the alloy includes a time at the first temperature up to about 8 hours, and a time at the second temperature up to about 5 hours, respectively.

18. The process of claim 15, further including cooling the alloy after heat treating at the second temperature at a rate between about 1° C. per minute and about 10° C. per minute to decompose the quantity of β-MnBi material therein to increase the quantity of α-MnBi material formed therein.

19. The process of claim 15, wherein milling the alloy includes sieving the alloy to collect the fractured α-MnBi material fraction as particles of a selected size.

20. The process of claim 15, wherein heat treating the fractured α-MnBi material fraction in vacuum includes removing residual (Bi) metal as a vapor from the fractured fraction at a vacuum pressure selected between about $1\times10^{-2}$ Torr and about $2\times10^{-5}$ Torr.

* * * * *